US005468166A

United States Patent [19]

Breivik et al.

[11] Patent Number: 5,468,166

[45] Date of Patent: Nov. 21, 1995

[54] SYSTEM FOR ROTATABLY MOUNTING A VESSEL TO A LOADING BUOY

[75] Inventors: Kare Breivik, Tau; Arne Smedal, Farvik; Kare Syvertsen, Arendal, all of Norway

[73] Assignee: Den Norske Stats Oleselskap A.S., Stavanger, Norway

[21] Appl. No.: 244,347

[22] PCT Filed: Mar. 30, 1992

[86] PCT No.: PCT/NO92/00058

§ 371 Date: Aug. 8, 1994

§ 102(e) Date: Aug. 8, 1994

[87] PCT Pub. No.: WO93/11035

PCT Pub. Date: Jun. 10, 1993

[30] Foreign Application Priority Data

Nov. 27, 1991 [NO] Norway ..... 914652

[51] Int. Cl.[6] ..... B63B 22/02

[52] U.S. Cl. ..... 441/5; 114/230

[58] Field of Search ..... 441/3–5; 114/293, 114/230; 141/382–388; 166/352, 359, 367

[56] References Cited

U.S. PATENT DOCUMENTS

| | | | |
|---|---|---|---|
| 4,100,752 | 7/1978 | Tucker | 441/4 |
| 4,490,121 | 12/1984 | Coopens et al. | 441/5 |
| 4,604,961 | 8/1986 | Ortloff et al. | 114/230 |
| 4,892,495 | 1/1990 | Svensen | 441/5 |

FOREIGN PATENT DOCUMENTS

| | | | |
|---|---|---|---|
| 0218491 | 12/1983 | Japan | 114/230 |

*Primary Examiner*—Edwin L. Swinehart

*Attorney, Agent, or Firm*—Jon Carl Gealow; Keck, Mahin & Cate

[57] ABSTRACT

A buoy for use in loading or unloading a flowable medium, especially oil from a vessel at sea. The buoy includes an outer member and a central member rotatably mounted in the outer member. The central member forms a passage for the flowable medium from the lower end of the buoy which is connected to a transfer line to a tube system within the vessel. The outer member is received and latched in an opening in the bottom of the vessel. The central member is connected to the tube system by a swivel means coupled to the upper end of the central member by a flexible joint which allows angular displacement about the axis of connection.

12 Claims, 3 Drawing Sheets

SYSTEM FOR ROTATABLY MOUNTING A VESSEL TO A LOADING BUOY

Figure 1:
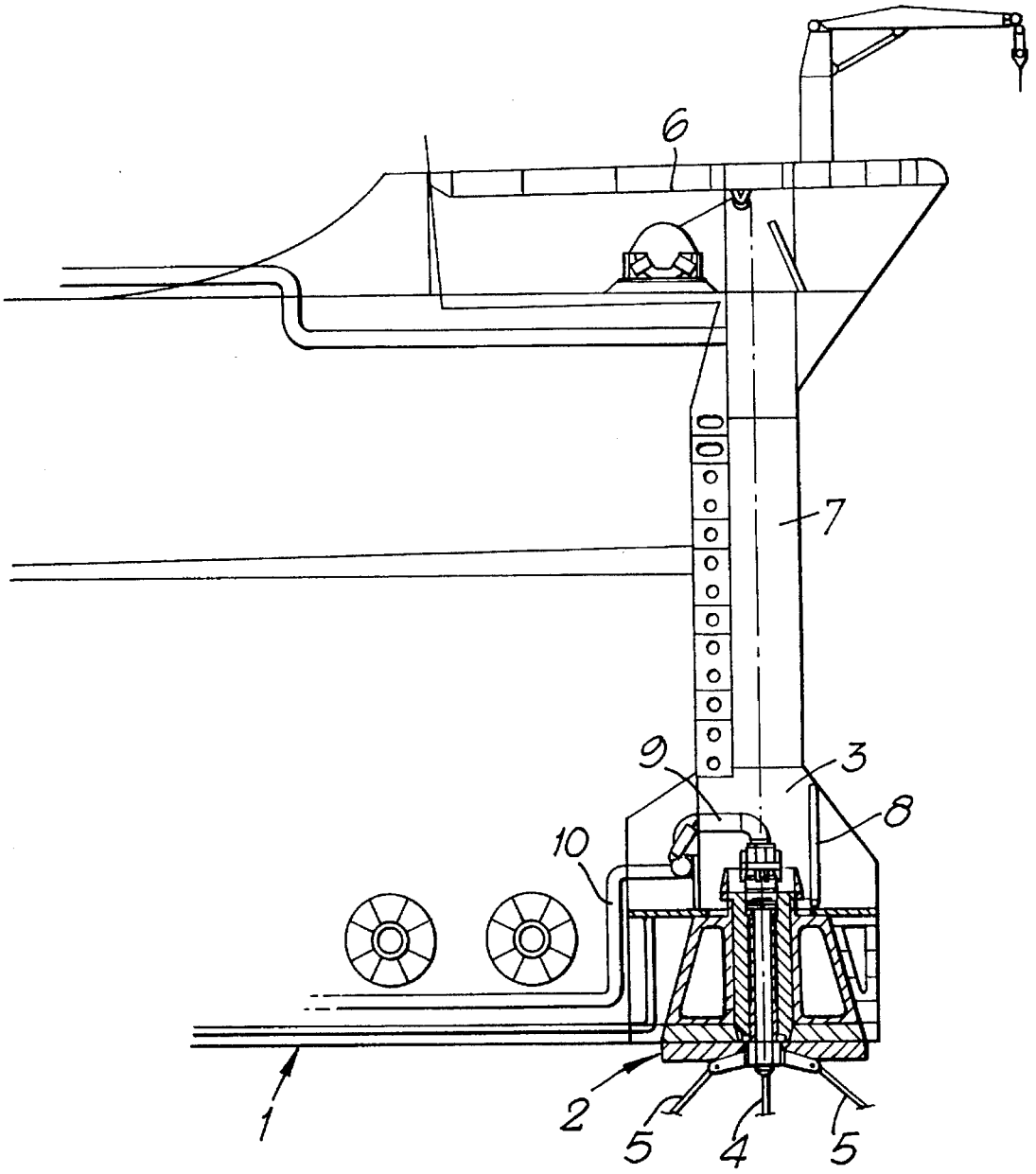

This application is a 371 of PICT/N092/00058, filed Mar. 30, 1992.

The invention relates to a system for rotatable mounting of a floating vessel to a submerged loading/unloading buoy which is anchored to the sea bed, the buoy being of the type which is adapted to be introduced into and fastened in a releasable manner in a submerged downwardly open receiving space in the vessel, the buoy during operation being connected to at least one transfer line and forming a transfer connection between this line and a tube system on the vessel.

There are previously known different types of loading/unloading systems for the transfer of hydrocarbons by means of a submerged buoy which, during operation, is received and secured in a submerged receiving space at the underside of a vessel. As examples of prior art, reference can be made to NO patent specification No. 160 914 and NO patent specification No. 167 960 (corresponds to U.S. Pat. No. 4,604,961).

In such buoy loading systems the underwater buoy is anchored to the sea bed, and there will then have to be provided a means making it possible for the vessel, during the influence of wind, current and waves, to turn about the anchored buoy. For this purpose, in the known system according to NO 167 906, there is provided a rotating body (turret) which is rotatably mounted in the receiving space in the hull of the vessel. Because of the fact that the rotating body is mounted to the hull, there arise large frictional forces which are to be overcome by torques from the buoy. These torques are relatively large due to the large outer diameter of the rotating body, and this results in correspondingly large loads. Further, it may result in uncontrolled rotation of the system because of large inertial forces, so that it becomes necessary to use a braking system for retaining the rotating body. In case of desired rotation the braking system is then released, and the rotating body is rotated in a controlled manner by means of active drive.

Further, the known system has a small ability to absorb moments caused by the horizontal mooring forces, something which results in a substantial risk for jamming actions in the mounting arrangement.

In practice, there may also occur large load forces at the place where the transfer line of the buoy enters into the buoy at the underside thereof. At this place there may arise large bending moments and torsional forces, and correspondingly large stresses on the transfer line, partly because of the pitching and rolling of the vessel under the influence of wind and waves, and partly because of the turning of the vessel and the occurring frictional forces between the rotating body and the hull of the vessel.

Thus, it is a general object of the invention to provide a system of the type in question which eliminates the above-mentioned drawbacks.

A more particular object of the invention is to provide a system enabling the buoy to be connected to the tube system of the vessel in a quick and safe manner, the connecting arrangement being able to absorb relatively large tolerances.

A further object of the invention is to provide a system making it possible to eliminate clamping moments between the buoy and the transfer line at the underside of the buoy.

The above-mentioned objects are achieved with a system of the introductorily stated type which, according to the invention, is characterized in that the buoy comprises an outer member which is arranged to be rigidly fastened in the receiving space, and a central inner member which is rotatably mounted in the outer member, so that the vessel is able to turn about the central member when the buoy is fastened in the receiving space, the upper end of the central member being connected to the tube system of the vessel through a swivel means and through at least one flexible Joint means.

In addition to the advantages originating from the achievement of the above stated objects, the system according to the invention among other things has the advantage that the rotary system is a part of the buoy itself, so that an expensive mounting as part of the vessel is avoided. In addition, the rotary bearing gets a small diameter, something which results in a small rotational resistance and a low rotary mass, and consequently no need for active control or braking of the rotary system. Further, the buoy structure provides a simple installation and dismantling, and correspondingly low costs. It is envisaged that the weight of the buoy will be in the region of 30–50 tons.

Figure 2:
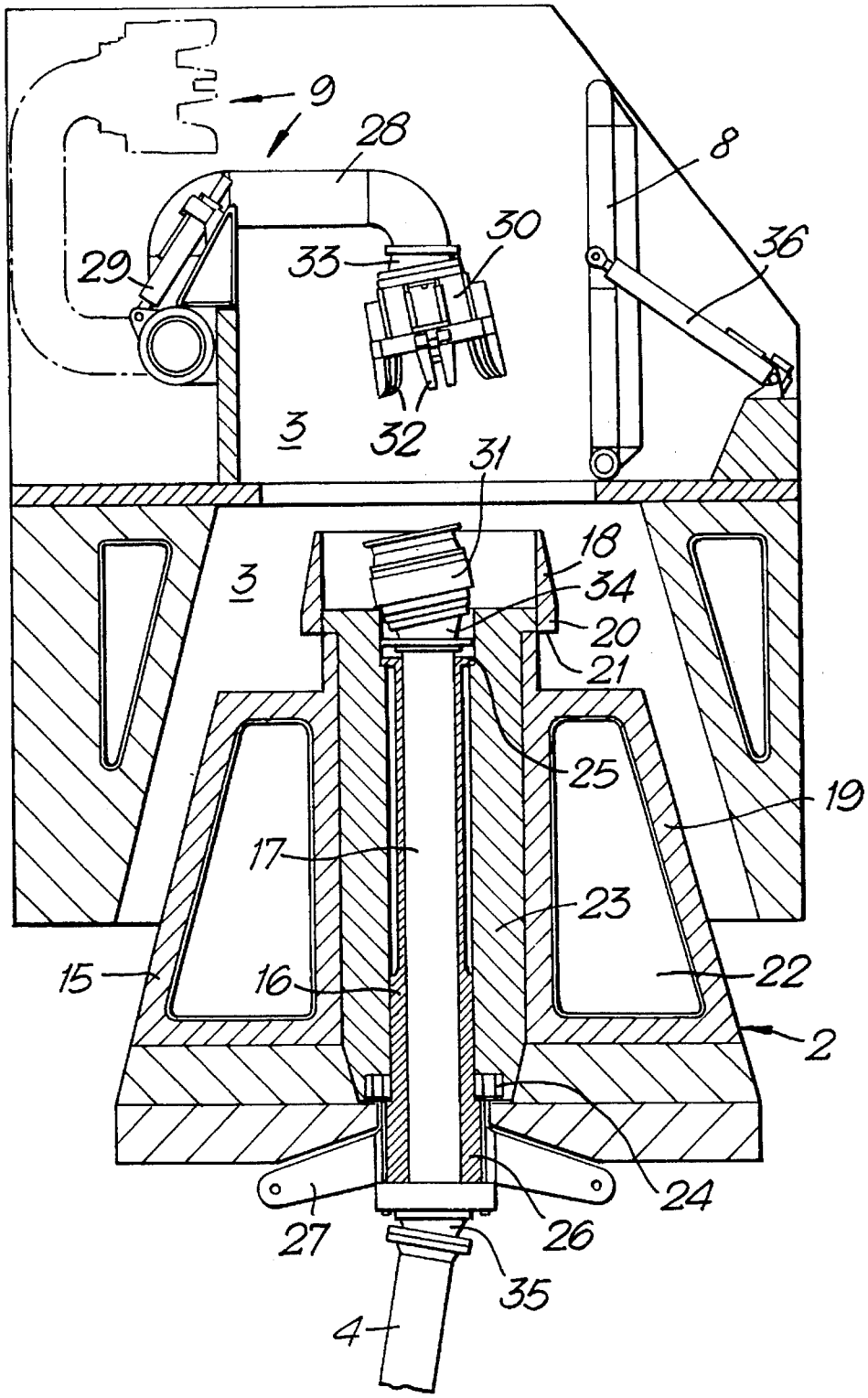
Figure 3:
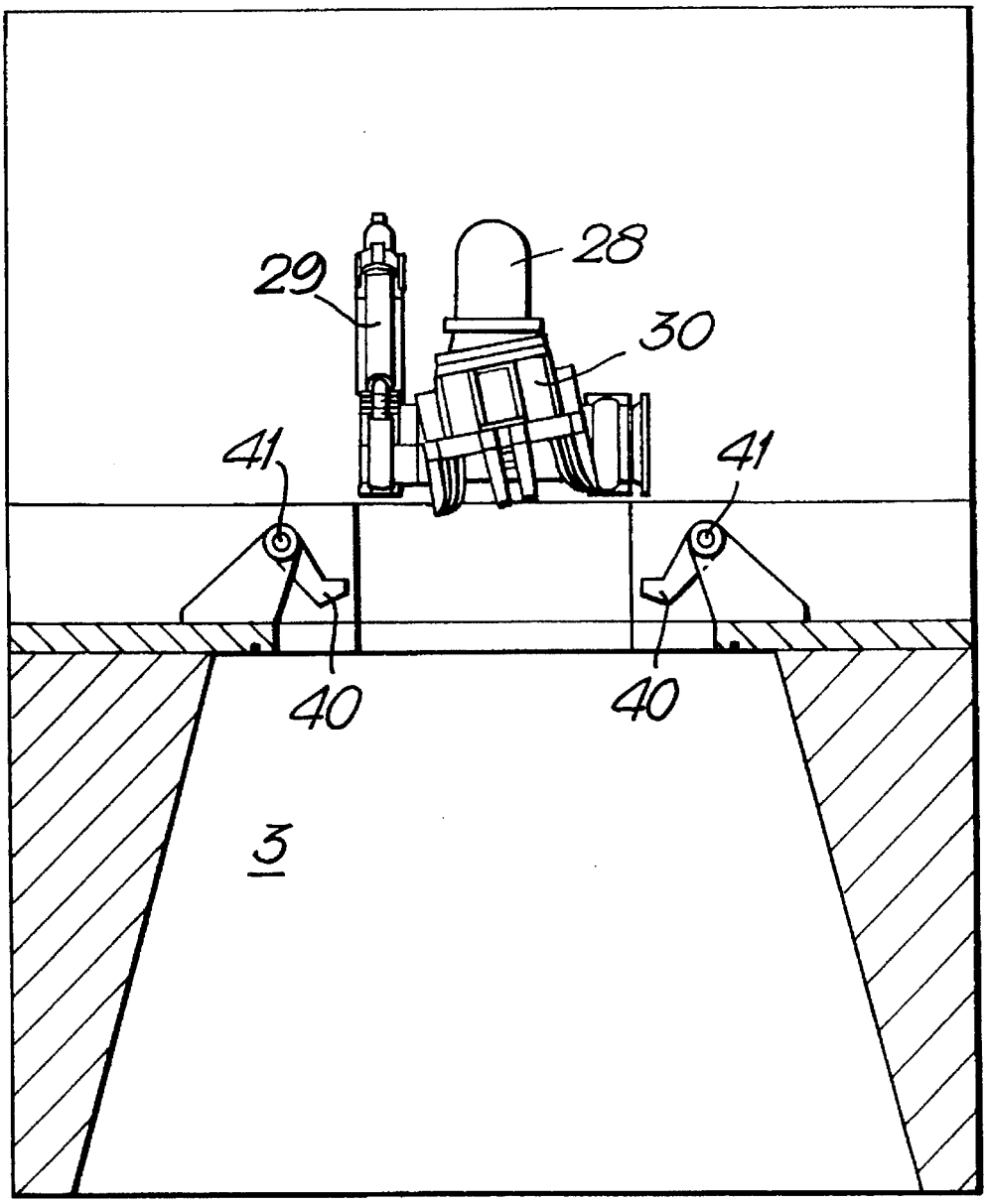

The invention will be further described below in connection with an exemplary embodiment with reference to the drawings, wherein FIG. 1 shows a partial side view of a vessel having a receiving space receiving a buoy which is constructed in accordance with the invention;

FIG. 2 shows a sectional side view of a receiving space in a vessel and a buoy adapted thereto; and FIG. 3 shows a schematic sectional view of the receiving space in FIG. 2, at right angles to the sectional plane in FIG. 2.

In the vessel shown in FIG. 1, a buoy 2 is received in a submerged receiving space 3 which is a part of a module arranged in the lower part of the bow of the vessel. The buoy is of the submerged type and is intended for transfer of a flowable medium, especially hydrocarbons, to or from tanks on board a tanker. To this end, the buoy us connected to a flexible transfer line 4, and further is anchored to the sea bed by means of a number of mooring lines suggested at 5. The receiving space 3 is connected with the deck 6 of the vessel through an access or service shaft 7. In the receiving space there is arranged a shutter 8 for shutting off the service shaft 7 and the upper part of the receiving space 3 from the sea when the receiving space is not in use, i.e. when it does not receive a buoy 2. This gives a possibility for inspection of equipment which will be arranged in the upper part of the receiving space, such as sensors and TV cameras for monitoring and control purposes.

The buoy 2 and the lower part of the receiving space 3 have a mating, conical shape, to ensure correct positioning of the buoy in the receiving space when the buoy is hoisted up and introduced in the receiving space. As appears from FIG. 1, in the upper part of the receiving space 3 there is arranged a coupling unit 9 which, in operation, is coupled to the buoy 2, and which further is connected to a tube system 10 leading to tanks (not shown) on board the vessel 1.

The construction of the buoy 2 and the coupling unit 9 is further shown in FIG. 2. As appears, the buoy comprises an outer buoyancy member 15 and a central member 16 which is rotatably mounted in the outer member and has a through-going passage 17 for medium to be transported via the buoy. As the Figure shows, the outer buoyancy member 15 comprises an upper and a lower cone member 18 and 19, respectively, and the upper cone member comprises a collar 20 having a downwards facing, annular abutment edge 21 for engagement with locking elements forming part of a locking mechanism (see FIG. 3) arranged in the receiving space 3 for locking of the buoy in the receiving space. The outer buoyancy member 15 is divided into several watertight buoyancy chambers 22, and it further comprises a central replaceable bearing support member 23 having a lower radial bearing 24 and an upper axial bearing 25 for the central member 16. When required, the bearing support member 23 may be lifted up from the outer buoyancy member 15 for inspection and possible replacement of parts.

The central member 16, which here has the form of a hollow shaft, is provided with a lower reinforced portion 26 having a number of outwardly projecting arms 27 for attachment of the mooring lines 5 of the buoy 2 (not depicted in FIG. 2).

The coupling unit 9 in the upper part of the receiving space 3 comprises a curved coupling tube 28 which, by means of a hydraulic cylinder 29, is pivotable between a stowed position and a connecting position (both positions shown in FIG. 2), one end of the tube being provided with a coupling head 30 for connection to the upper end of the central member 16 of the buoy when the buoy is in place in the receiving space. This connection takes place through a swivel means 31 which is arranged at the top of the central member 16 of the buoy. The coupling head 30 is provided with a number of peripherally arranged locking arms 32 for guiding the coupling head towards the swivel means 31 and provide for a safe interconnection. Further, the coupling head is provided with a flexible joint 33 to provide flexibility and give a possibility for obtaining relatively large dimensional tolerances when connecting the buoy to different vessels. A flexible joint 34 is also arranged between the central member 16 and the swivel means 31, to provide additional flexibility and reduce stresses and wear in the interconnection. The coupling head 30 possibly may be arranged to carry out searching movements, by means of e.g. hydraulic actuation, for obtaining a correct connection to the swivel means. As mentioned above, there may in addition be provided for a monitoring means, for example a combination of sensors and TV cameras. The flexible joints may, e.g., be ball joints, or joints of a flexible material.

The third flexible joint 35, which also may be e.g. a ball joint, is arranged between the lower end of the central member 16 and the transfer line 4 of the buoy. This flexible joint provides the substantial advantage of a moment-free transfer of forces from the transfer line 4 to the buoy 2, and in addition it facilitates the positioning of the buoy in relation to the receiving space 3, so that the buoy slides easily in place therein.

The aforementioned closing shutter 8 in the upper part of the receiving space 3 is shown to be operated by a hydraulic cylinder 36.

The locking mechanism for releasable locking of the buoy when it is in place in the receiving space 3, is schematically shown in FIG. 3. In the illustrated embodiment the mechanism comprises a pair of locking dogs 40 which are actuated by a hydraulic system and are rotatable about horizontal axes 41 at diametrically opposite sides of the receiving space 3. The hydraulic actuators (not shown) for operation of the locking dogs may, e.g., be hydraulic cylinders. When activating the locking dogs 40, these will pivot in a vertical plane into engagement with the downwards facing abutment edge 21 of the upper cone member 18 of the buoy. The hydraulic cylinders advantageously are connected in parallel to the hydraulic drive system, so that they automatically compensate for possible unevennesses in the abutment edge. The locking dogs 40 provide for rigid locking of the outer buoyancy member 15 of the buoy to the receiving space 3, and the vessel then is allowed to turn about the rotatably mounted central member 16, the swivel means 31 allowing such turning after the coupling tube 28 having been coupled to the buoy. The hydraulic actuators preferably are arranged to actuate a mechanical locking means (not shown), so that the buoy 2 is kept securely in place in the locked position, also in case of failure in the hydraulic system.

We claim:

1. A system for connection of a submerged loading/unloading buoy to a floating vessel, said buoy comprising an inner member and an outer member rotatably mounted on said inner member and said vessel having a submerged downwardly open receiving space adapted to receive said buoy therein, said system comprising:

latching means within said receiving space for releasably latching said outer member to said vessel when said buoy is received within said receiving space whereby said vessel and said outer member can turn about said inner member, at least one transfer line extending to said inner member, a tube system in said vessel, connecting means for establishing a transfer connection between said tube system and said inner member, said connecting means comprising swivel means coupled to the upper end of said inner member by a flexible joint which allows angular displacement thereof about the axis of connection, said central member comprising a hollow shaft.

2. The system of claim 1 further comprising a coupling unit connected to said tube system, and a coupling head included in said coupling unit, said swivel means being arranged to couple with said coupling head.

3. The system of claim 2 comprising a further flexible joint between said tube system and said coupling head.

4. The system of claim 1 wherein said inner member is provided with a further flexible joint at the lower end thereof for moment-free transfer of forces from said transfer line to said buoy.

5. The system of claim 1 wherein said flexible joint is a ball joint.

6. A system for connection of a transfer line to a pipe system of a floating vessel, said system comprising:

a submerged loading/unloading buoy, said buoy comprising an inner member, a passage extending through said inner member, and an outer member rotatably mounted on said inner member, said transfer line extending to said inner member and communicating with said passage, a submerged downwardly open receiving space in said floating vessel, said receiving space being adapted to receive said buoy therein, securement means within said receiving space for releasably securing said outer member to said vessel when said buoy is received within said receiving space, whereby said vessel and said outer member can turn about said inner member and said transfer line, and first and second cooperating coupling means mounted on each of said upper end of said inner member and an end of said pipe system respectively for coupling said upper end of said inner member with said pipe system, at least one of said coupling means comprising a swivel means, and at least one of said coupling means comprising a flexible joint allowing angular displacement of said coupling means about the axis of coupling.

7. The system of claim 6 wherein said coupling means are arranged such that said flexible joint is located between said swivel means and said inner member upper end.

8. The system of claim 7 wherein said first coupling means comprises swivel means connected to said inner member upper end by way of said flexible joint.

9. The system of claim 8 wherein said second coupling means further comprises a coupling head releasably engageable with said swivel means.

10. The system of claim 6 wherein said second coupling means comprises a coupling tube pivotably mounted in said receiving space, a coupling head, and a flexible joint between said coupling tube and said coupling head, said first coupling means comprising said swivel means and being engageable by said coupling head.

11. The system of claim 10 wherein said first coupling means has a further flexible joint between said swivel means and said inner member.

12. The system of claim 6 wherein said flexible joint is a ball joint.

* * * * *

UNITED STATES PATENT AND TRADEMARK OFFICE

CERTIFICATE OF CORRECTION

PATENT NO. : 5,468,166

DATED : November 21, 1995

INVENTOR(S) : Kare Breivik, Arne Smedal & Kare Syvertsen

It is certified that error appears in the above-indentified patent and that said Letters Patent is hereby corrected as shown below:

Cover Page, Delete

[73] Assignee: Den Norske Stats Oleselskap A.S.

Substitute

[73[ Assignee: Den Norske Stats Oljeselskap AS

Signed and Sealed this

Nineteenth Day of November, 1996

*Attest:*

*Attesting Officer*

BRUCE LEHMAN

*Commissioner of Patents and Trademarks*